United States Patent [19]

Suga et al.

[11] Patent Number: 4,623,406

[45] Date of Patent: Nov. 18, 1986

[54] METHOD FOR PRODUCING A GRAIN-ORIENTED ELECTRICAL STEEL SHEET HAVING A HIGH MAGNETIC FLUX DENSITY

[75] Inventors: Yozo Suga, Kitakyushu; Fumio Matsumoto, Kawasaki; Tadashi Nakayama, Kitakyushu, all of Japan

[73] Assignee: Nippon Steel Corporation, Tokyo, Japan

[21] Appl. No.: 534,290

[22] Filed: Sep. 21, 1983

[30] Foreign Application Priority Data

Sep. 24, 1982 [JP] Japan ..... 57-165065

[51] Int. Cl.[4] ..... H01F 1/04

[52] U.S. Cl. ..... 148/111; 148/308; 420/117

[58] Field of Search ..... 148/110, 111, 112, 113, 148/31.55; 75/123 B, 123 D, 123 L

[56] References Cited

U.S. PATENT DOCUMENTS

| | | | |
|---|---|---|---|
| 1,773,157 | 8/1930 | Wooldridge | 75/123 L |
| 2,599,340 | 6/1952 | Littmann et al. | 148/12.5 |
| 2,867,557 | 1/1959 | Crede et al. | 148/111 |
| 3,278,346 | 10/1966 | Goss | 75/123 L |
| 3,287,183 | 11/1966 | Taguchi et al. | 148/111 |
| 3,671,337 | 6/1972 | Kumai et al. | 148/111 |
| 3,764,406 | 10/1973 | Littmann | 148/111 |
| 3,841,924 | 10/1974 | Sakakura et al. | 148/111 |
| 3,846,187 | 11/1974 | Sakakura et al. | 148/112 |
| 3,853,641 | 12/1974 | Sakakura et al. | 148/111 |
| 3,867,211 | 2/1975 | Easton | 148/31.55 |
| 3,932,234 | 1/1976 | Imanaka et al. | 148/112 |
| 3,933,537 | 1/1976 | Imanaka et al. | 148/111 |
| 3,940,299 | 2/1976 | Goto et al. | 148/31.55 |
| 4,023,990 | 5/1977 | Lex | 75/123 L |
| 4,108,694 | 8/1978 | Shiozaki et al. | 148/111 |
| 4,299,622 | 11/1981 | Kimira et al. | 75/123 D |
| 4,302,257 | 11/1981 | Matsumoto et al. | 148/111 |
| 4,319,936 | 3/1982 | Dahlstrom et al. | 148/111 |
| 4,439,251 | 3/1984 | Shimoyama et al. | 148/31.55 |
| 4,456,812 | 6/1984 | Neiheisel et al. | 148/111 |

FOREIGN PATENT DOCUMENTS

| | | | |
|---|---|---|---|
| 2060697 | 5/1981 | United Kingdom | 148/31.55 |

OTHER PUBLICATIONS

A Study on the Occurrence of High Permeability in Grain Oriented Silicon Steel-Hi-B by Takashima et al. Proceedings, No. 29, Magnetism and Magnetic Materials-1975.

Effects of Aln on the Secondary Recrystallization Behavior of 3% Si-Fe (110)[001] Single Crystals by Fumio Matsumoto et al. AIP Conference Proceedings, No. 18, Magnetism and Magnetic Materials-1973.

*Primary Examiner*—John P. Sheehan

*Attorney, Agent, or Firm*—Kenyon & Kenyon

[57] ABSTRACT

The present invention relates to a method for producing a grain-oriented electrical steel sheet.

A feature of the present invention is to set S≦0.007%, Mn=0.08~0.45%, P=0.015~0.45% in a slab. The present inventive idea does away with the conventional concept of using MnS as an inhibitor. The present invention present incomplete secondary recrystallization by the S content, which is decreased to a level as low as possible. In addition, a product having a high magnetic flux density can be successfully produced by adding appropriate amounts of Mn and P. Due to these advantages a high Si content of a slab, which leads to a watt loss reduction, can also be employed in the present invention. Furthermore, the watt loss of a product produced by a low-temperature slob-heating is considerably lower than a product produced by a high-temperature slab-heating.

4 Claims, 9 Drawing Figures

S: 0.004 %

S: 0.007 %

S: 0.012 %

S: 0.030 %

METHOD FOR PRODUCING A GRAIN-ORIENTED ELECTRICAL STEEL SHEET HAVING A HIGH MAGNETIC FLUX DENSITY

BACKGROUND OF THE INVENTION

1. Field of the Invention

The present invention relates to a method for producing a grain-oriented electrical steel sheet having a high magnetic flux density.

2. Description of the Prior Art

Grain-oriented electrical steel sheet is a soft magnetic material composed of crystal grains having a so called Goss texture, expressed by {110}<001> by the Miller index in which the crystal orientation of the sheet plane is the {110} plane and the crystal orientation of rolling direction is parallel to the <001> axis. Grain-oriented electrical steel sheet is used for cores of transformers, generators, and other electrical machinery and devices.

Grain-oriented electrical steel sheet must have excellent magnetization and watt loss characteristics. The magnetization characteristic is defined by the magnitude of the magnetic flux density induced in the grain-oriented electrical steel sheet by a predetermined magnetic field. Here $B_{10}$ is used. Soft magnetic material having a high magnetic flux density, i.e., a good magnetization characteristic, can advantageously reduce the size of the electrical machinery and devices.

Watt loss is defined as the power lost due to consumption as thermal energy in a core when it is energized by an alternating magnetic field having a predetermined intensity. Here, $W_{17/50}$ is used. As is known, the watt loss characteristic is influenced by the magnetic flux density, sheet thickness, impurities, resistivity, and grain size of the grain-oriented electrical steel sheet. Increased demand has arisen for grain-oriented electrical steel sheet having a low watt loss along with the trend toward energy conservation.

Grain-oriented electrical steel sheet is produced by hot-and-cold rolling a slab to the desired final sheet thickness and then finally annealing the resultant steel strip to realize selective growth of the {110}<001> oriented primary-recrystallized grains, i.e., to realize so-called secondary recrystallization.

To realize secondary recrystallization, fine precipitates, such as MnS and AlN, must be finely and uniformly dispersed in phases in the steel, while the strip steel is subjected to processes prior to the final high temperature annealing, so as to suppress growth of primary recrystallized grains having orientations other than the {110}<001> orientation during the final high temperature annealing (inhibitor effect). Controlling the secondary recrystallization, it is possible to increase the proportion of the accurately {110}<001> oriented grains in the crystal grains, thereby increasing the magnetic flux density of the grain-oriented electrical steel sheet and, thus, reducing the watt loss. It is important to develop production techniques allowing control of the secondary recrystallization.

Japanese Examined Patent Publication (Kokoku) No. 40-15644 (Taguchi et al) and Japanese Examined Patent Publication (Kokoku) No. 51-13469 (Imanaka et al) disclose basic techniques for producing a grain-oriented electrical steel sheet with enhanced magnetic flux density and decreased watt loss.

The basic techniques dislcoses in the above two Japanese examined patent publications however suffer from some fundamental problems. In the method disclosed in Japanese Examined Patent Publication No. 40-15644, it is difficult to achieve overall optimum production conditions and to stably produce grain-oriented electrical steel sheets having a high magnetic flux density. As a result, the method is not appropriate for the stable production of products having the best magnetic properties.

The method disclosed in Japanese Examined Patent Publication No. 51-13469 involves double cold rolling and use of an expensive element, such as Sb or Se. This method therefore involves high production costs. Japanese Unexamined Patent Publication No. 48-51852 discloses an improvement of the method of Japanese Examined Patent Publication No. 40-15644. In this method, the Si content of the starting material is increased. A high silicon content however, narrowly restricts the conditions under which AlN appropriate for the secondary recrystallization can be ensured in the hot-rolled strip.

The recent adoption of continuous casting has created additional problems in the production of grain-oriented electrical steel sheet. In continuous casting linear, secondary-recrystallization-incomplete portions, referred to as streaks, are occasionally generated in the steel. This impairs the magnetic properties of the steel. The problem of streaks is greatly aggravated by a high Si content. When the Si content exceeds 3.0%, stable production of grain-oriented electrical steel sheet becomes extremely difficult.

Japanese Unexamined Patent Publication No. 48-53919 (M. F. Littman) discloses to remove the problem of streaks by subjecting a continuously cast steel strand to double hot-rolling steps when producing a hot rolled strip. Japanese Unexamined Patent Publication No. 50-37009 (Akira Sakakura et al) discloses a method for producing grain-oriented electrical steel sheet wherein a hot-rolled steel strip is produced by double hot-rolling steps. These two prior art methods, however, do not fully utilize the advantages of continuous casting, i.e., omission of rough rolling. Two later publications, Japanese Unexamined Patent Publication No. 53-19913 (Morio Shiozaki et al) and Japanese Unexamined Patent Publication No. 54-120214 (Fumio Matsumoto et al), disclose how to employ single hot-rolling to produce grain-oriented electrical steel sheet using a continuously cast strand. These proposals, however, necessitate reconstruction of a casting or rolling installation and still do not completely solve the problem of streak generation.

SUMMARY OF THE INVENTION

It is an object of the present invention to provide a method for producing a grain-oriented electrical steel sheet having magnetic flux density $B_{10}$ of 1.89 Tesla or more using a single hot-rolling step.

It is another object of the present invention to provide a method for producing a grain-oriented electrical steel sheet in which excellent secondary recrystallization can be obtained at a higher Si content than in the prior art.

It is still another object of the present invention to provide a method for producing a grain-oriented electrical steel sheet in which excellent secondary recrystallization can be obtained under less strict conditions than in the prior art.

It is still another object of the present invention to provide a method for producing a grain-oriented electrical steel sheet using a continuously cast slab.

The essence of the method according to the present invention resides in the steps of: heating, to a temperature of from more than 1280° C. to 1430° C., a slab which essentially consists of from 0.025% to 0.075% of C., from 3.0% to 4.5% of Si, from 0.010% to 0.060% of acid soluble aluminum, from 0.0030% to 0.0130% of N, not more than 0.007% of S, from 0.08% to 0.45% of Mn, and from 0.015% to 0.045% of P, the balance being Fe; hot rolling the slab to form a hot-rolled strip; annealing the hot-rolled strip at a temperature in the range of from 850° C. to 1200° C. for a short period of time; heavily cold-rolling the annealed strip at a reduction of not less than 80%, thereby obtaining the final sheet thickness; continuously decarburization-annealing the obtained cold-rolled strip in a wet hydrogen atmosphere and then applying an annealing separator on the strip; and carrying out final high temperature annealing.

One of the features according to the present invention is the sulfur content of 0.007% or less. In the prior art, as disclosed in Japanese Examined Patent Publication Nos. 30-3651, 40-15644, and 47-25250, sulfur is believed useful for producing grain-oriented electrical steel sheet since sulfur forms MnS, one of the indispensable precipitates for generating secondary recrystallization. According to these publications, the effect of sulfur is most prominent in a certain range of content is determined by the amount of solute MnS brought into solid solution during the slab-heating process. AlN also forms precipitates believed useful for producing a grain-oriented electrical steel sheet. Conventionally, both MnS and AlN precipitates had to be used as inhibitors in a production process for producing grain-oriented electrical steel sheets having high magnetic flux density, which process including a hevy cold rolling.

The present inventors investigated in detail the precipitation behavior of MnS and AlN. They discovered that when a slab having the composition of an electrical steel sheet is heated and then hot-rolled and when a hot-rolled strip is annealed, MnS first precipitates at a high temperature and AlN then precipitates at a low temperature. Since MnS is already present in the steel when AlN precipitates, AlN tends to precipitate around the MnS, resulting in complex precipitation. Thus, the size and dispersion state of AlN are influenced by the precipitation states of MnS. That is, when the amount of MnS precipitated is great, the AlN is large sized and is dispersed non-uniformly.

As known from Japanese Unexamined Patent Publication No. 48-51852, a fundamental metallurgical concept for producing a grain-oriented electrical steel sheet having a high magnetic flux density with a single cold-rollirg process is to create an appropriate dispersion state of AlN by utilizing the $\alpha \rightarrow \gamma$ transformation which occurs during hot-rolling or annealing. When the Si content is high, the $\alpha \rightarrow \gamma$ transformation is disadvantageously changed, so that dispersion of AlN is impaired. In the case of continuous casting, this is believed to result in generation of streaks.

Based on the above-described discoveries and consideration of the $\alpha \rightarrow \gamma$ transformation, the present inventors decreased the precipitation amount of MnS. They then discovered that, even with a high content of Si in the steel, the dispersion state of AlN can be kept uniform and the AlN precipitates be kept small in size.

One of the features according to the present invention resides therefore in the point that the sulfur content is lower than in the prior art. Even with this, the precipitation of AlN can be controlled appropriately and the generation of streaks in continuous casting which may occur when the Si content is high, can be prevented.

Since the S content is low, the precipitation amount of MnS according to the present invention is less than in the prior art. The decrease in the precipitation amount of MnS means the total amount of the inhibitors is decreased, which leads to a decrease in the magnetic flux density. To compensate for the decrease in the magnetic flux density, Mn and P are added into steel in appropriate amounts. Another feature according to the present invention resides in the fact that the Mn and P added to the steel do not change the inhibitors but render the primary recrystallization texture appropriate before the secondary recrystallization. That is, they compensate for the above-mentioned decrease in magnetic flux density is and even increase in the magnetic flux density by texture control. The crystal grains are refined and have a uniform size, with the result that the second recrystallization is stabilized.

Another feature according to the present invention is that Si content in the starting material is at least 3.0%. This results in one of the lowest watt losses available in the high grade grain-oriented electrical steel sheet.

BRIEF DESCRIPTION OF THE DRAWINGS

The present invention will be described in further detail with reference to the drawings, wherein.

DESCRIPTION OF THE PREFERRED EMBODIMENTS

Figure 1A:
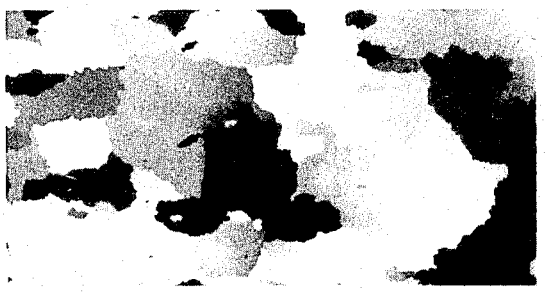
FIGS. 1A to D show photographs of the crystal grain-macrostructures of the products produced using steels containing 0.004%, 0.007%, 0.012%, and 0.025% of S.
Figure 1B:
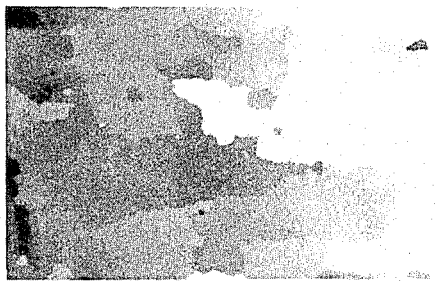
Figure 1C:
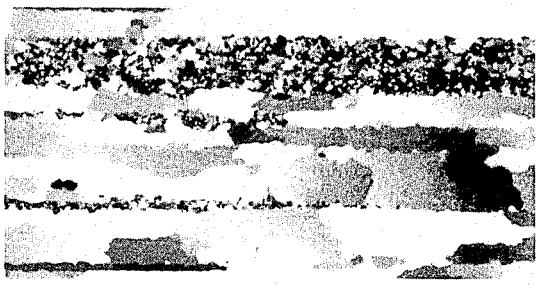
Figure 1D:
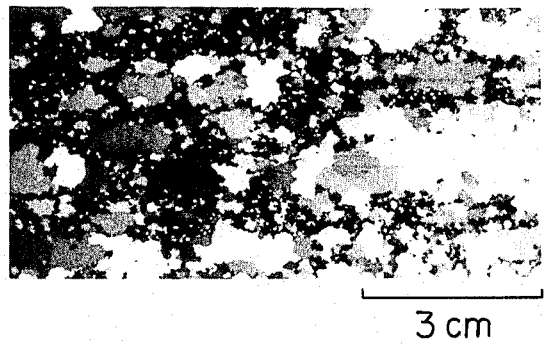

Four continuously cast slabs, in which the S contents were 0.004%, 0.007%, 0.012%, and 0.030%, respectively, and which contained 0.055% of C, 3.30% of Si, 0.25% of Mn, 0.035% of P, 0.030% of acid-soluble aluminum, and 0.0080% of N, were heated to 1410° C. in a furnace and were hot-rolled to form a 2.3 mm thick hot-rolled sheets. Then, the following processes were successively carried out: continuous annealing at 1150° C. for 2 minutes; cold-rolling to form a 0.30 mm cold-rolled strip; decarburization-annealing in a wet hydrogen atmosphere; application of MgO as annealing separator; and final high temperature annealing at 1200° C. for 20 hours.

As is apparent from the crystal-grain macrostructures of the products shown in FIG. 1, no incomplete secondary recrystallization occurs when the S content is 0.007% or less. Also, according to experiments of the present inventors, no incomplete secondary recrystallization occurs when the Si content was 4.5% or less and when the S content was 0.007% or less. Accordingly, the S content is limited to 0.007% or less in the present invention. The S content is desirably decreased in the stage of melting steel because the desulfurization treatment during the final high temperature annealing can be facilitated. According to the present melting techniques for decreasing sulfur, the S content which can be easily attained without incurring cost increases is usually 0.001% or more.

Continuously cast slabs, in which the Mn and P contents were varied, and which contained 0.060% of C, 3.45% of Si, 0.004% of S, 0.033% of acid-soluble aluminum, and 0.0090% of nitrogen, were heated to 1410° C. and were then hot-rolled to form a 2.3 mm thick hot-rolled strips. Then, the following processes were successively carried out: continuous annealing at 115° C. for 2 minutes; cold-rolling to form 0.30 mm cold-rolled strips; decarburization-annealing at 850° C. for 2 minutes in a wet hydrogen atmosphere; application of MgO as annealing separator; and final high temperature annealing at 1200° C. for 20 hours.

Figure 2:
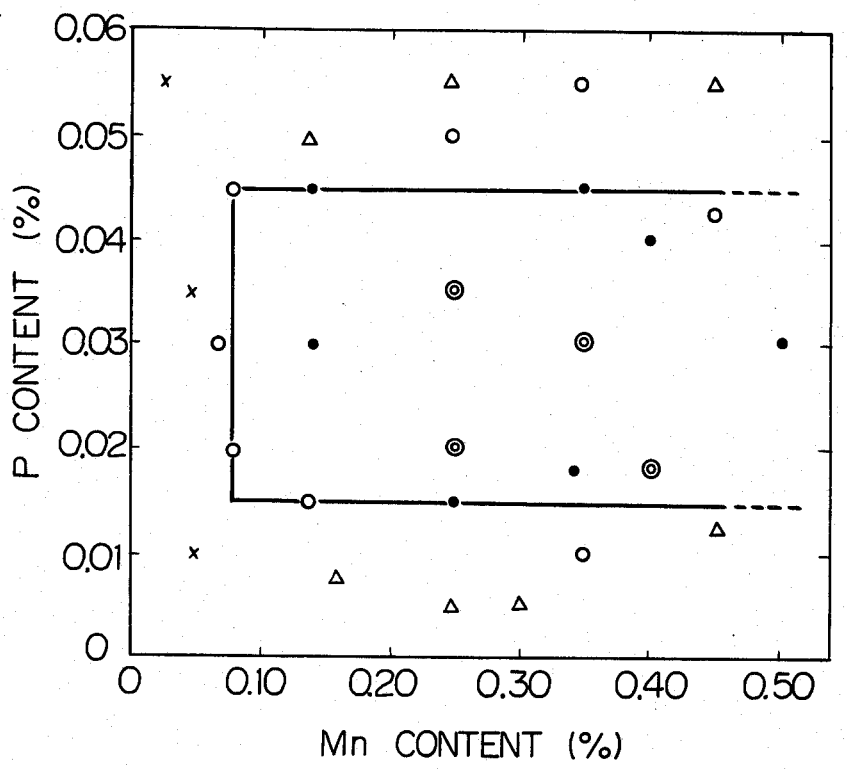
FIG. 2 is a graph of the influence of Mn and P upon $B_{10}$, regarding a product produced by using a continuously cast slab containing 0.0090% of N.

The magnetic flux density $B_{10}$ of the product is shown in FIG. 2, wherein x represents to $B_{10}<1.80$ Tesla, Δ corresponds to $1.80 \leqq B_{10}<1.89$ Tesla, o corresponds to $1.89 \leqq B_{10}<1.92$ Tesla, . corresponds to 1.92 Tesla $\leqq B_{10} \leqq 1.93$ Tesla and . corresponds to $1.93 \leqq B_{10}$. As is apparent from FIG. 2, when the Mn content is too low, the secondary recrystallization becomes unstable, and when the Mn content is high, the magnetic flux density $B_{10}$ is high. When Mn is added in more than a certain content, however, it is ineffective for enhancing the magnetic flux density $B_{10}$ and is uneconomical since the amount of additive alloy becomes disadvantageously great.

When the P content is low, the magnetic flux density $B_{10}$ is too low and the generation of incomplete secondary recrystallization is increased. When the P content is too high, the frequency of cracking during cold rolling is increased.

Thus, the Mn content is limited to the range of from 0.08% to 0.45%, and the P content is limited to the range of from 0.015% to 0.045% according to the present invention. In these ranges, the magnetic flux density $B_{10}$ is 1.89 Tesla or more, the secondary recrystallization is stable, and the problem of cracking is not significant.

Regarding the other components, steel which is subjected to the processes according to the present invention may be melted in a converter, electric furnace, or open-hearth furnace, provided that the composition of steel falls within the ranges described hereinafter.

The C content is thus at least 0.025%. At a C content of less than 0.025%, secondary recrystallization is instable. Even if secondary recrystallization occurs, the magnetic flux density is low ($B_{10}$ is 1.80 Tesla at the highest). On the other hand, the C content is 0.075% at the highest, since the decarburization annealing time is long and thus uneconomical when the C content exceeds 0.075%.

The Si content is 4.5% at the highest. At an Si content exceeding 4.5%, numerous cracks occur during the cold-rolling. The Si content is at least 3.0%, preferably at least 3.2%. At an Si content less than 3.0%, the highest grade watt less, i.e., $W_{17/50}$ of 1.05 w/kg at the sheet thickness of 0.30 mm, cannot be obtained.

Since in the present invention AlN is employed for the precipitates indispensable for the secondary recrystallization, the minimum amount of AlN must be ensured by providing an acid-soluble Al content and N content of at least 0.010% and 0.0030%, respectively. The acid-soluble Al content is 0.060% at the highest. At an acid-soluble Al content exceeding 0.060%, the AlN does not disperse uniformly in the hot-rolled strip.

The slab used may be any slab produced by a rough rolling or continuous casting. A continuously cast slab is preferable due to the inherent labor saving and yield-enhancement features of continuous casting. Furthermore, continuous casting ensures a uniform chamical composition in a slab, resulting in uniform magnetic properties in the longitudinal direction of the product.

As is described in Japanese Unexamined Patent Publication No. 53-19913, if a continuously cast slab is heated to a high temperature, such as approximately 1320° C., where abnormal grain growth occurs, streaks generate and thus stable production becomes impossible. Contrary to this, according to the present invention, streaks do not form at a temperature exceeding 1320° C.

The magnetic flux density is strongly influenced by a slab-heating temperature. Continuously cast slabs which contained 0.057% of C, 3.50% of Si, 0.25% of Mn, 0.039% of P, 0.033% of acid-soluble Al, and 0.0085% of N were heated and hot-rolled by the single hot rolling method to form 2.5 mm thick hot-rolled strips. Then, the following processes were successively carried out: continuous annealing at 1120° C. for 2 minutes; cold-rolling to form 0.30 mm cold-rolled sheets; decarburization-annealing at 850° C. for 2 minutes in a wet hydrogen atmosphere; application of MgO as annealing separator; and final high temperature annealing at 1200° C. for 20 hours.

Figure 3:
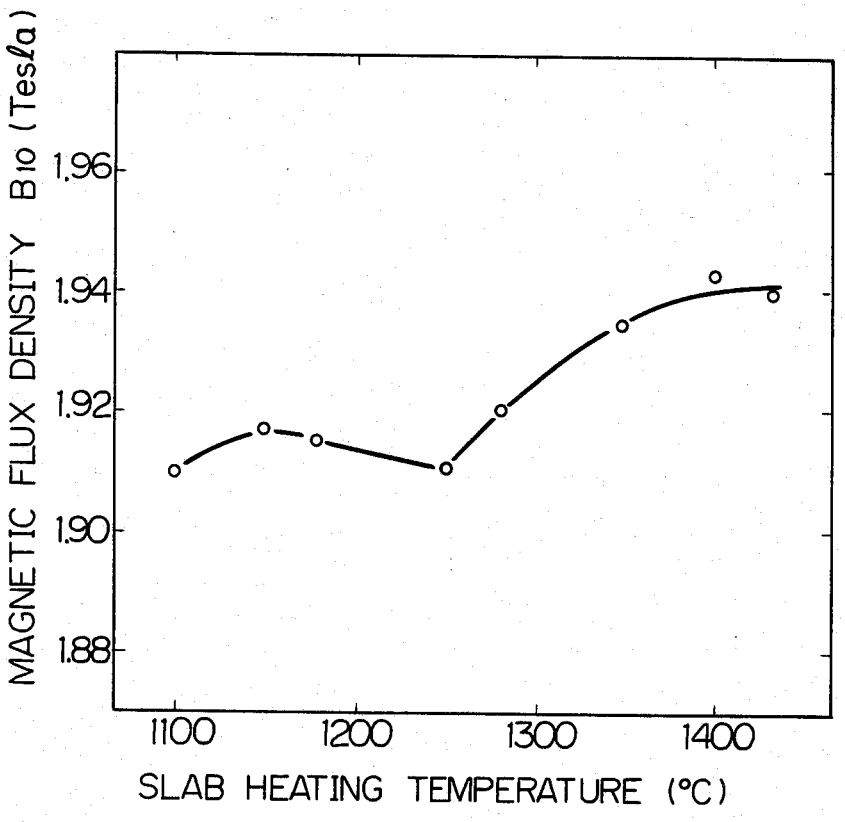
FIG. 3 is a graph of the influence of a slab-heating temperature upon the magnetic flux density of products.

The magnetic flux density $B_{10}$ of the products are shown in FIG. 3. As is apparent from FIG. 3, a higher magnetic flux density $B_{10}$ may be obtained with a slab heating temperature exceeding 1280° C. In many cases, such a higher magnetic flux density is specifically desired. The watt loss can be more greatly decreased due to a laser beam irradiation when magnetic flux density is higher. A laser-beam irradiation technique for reducing the watt loss is advantageously utilized for the grain-oriented electrical steel sheet produced by the high-temperature method according to the present invention. Such a technique is effective for providing especially low watt loss.

In the method according to the present invention, the hot-rolled strip is annealed at a temperature of from 850° C. to 1200° C. for a short period of time and then rapidly cooled to control the precipitation state of AlN. If the annealing temperature is lower than 850° C., a high magnetic flux density cannot be obtained. On the other hand, if the annealing temperature is higher than 1200° C., the secondary recrystallization becomes incomplete. An annealing time of 30 seconds or longer is sufficient for attaining the object of annealing, and an annealing time longer than 30 minutes is economically disadvantageous. The annealing time is usually from 1 to 3 minutes.

The annealing hot-rolled strip, which may be referred to as a hot-coil, is then cold-rolled. Heavy cold-rolling with reduction degree or draft of at least 80% is necessary in the cold-rolling for producing a grain-oriented electrical steel sheet having a high magnetic flux density.

The cold-rolled strip is then decarburization-annealed. The aims of the decarburization annealing are to decarburize and primary-recrystallize a cold-rolled strip and simultaneously to form on it an oxide layer which is necessary as an insulating film.

An annealing separator, which is necessary for forming an insulating film on the product, is applied on the surface of decarburization-annealed strip. The annealing separator is mainly composed of MgO and may additionally comprise, if necessary, one or more of $TiO_2$, $Al_2O_3$, CaO, B-compound, S-compound, and N compound.

Subsequently, final high-temperature annealing is carried out. The aims of the final high-temperature annealing are to secondary-recrystallize and purify a decarburization-annealed strip and to form an insulating film mainly composed of for, sterite.

Regarding the conditions of the final high-temperature annealing, the heating rate at a temperature range where the secondary recrystallization occurs is preferably slow, because this is effective for attaining a stable high magnetic flux density. In metallurgical terms, in a secondary recrystallization temperature range, the secondary recrystallized grains having a smaller inclination from the {110}<001> orientation generate at a lower temperature. Therefore, the slow heating can enhance the volume proportion of the secondary recrystallized grains which are generated at a low temperature and thus are close to the {110}<001> orientation, with the result that the magnetic flux density is enhanced. In addition, since the growth of crystal grains is less liable to be suppressed due to fine MnS particles in the present invention, in which the S content is low and the inhibiting effects due to fine MnS particles are small, as compared with the conventional methods, in which the amount of MnS is great, the grain growth occurs relatively actively at a low temperature. Thus, slow heating is particularly effective in the case of low S steel for increasing the volume proportion of the secondary recrystallized grains which are generated at a low temperature and are thus close to the {110}<001> orientation, and thus enhancing the magnetic flux density.

Figure 4:
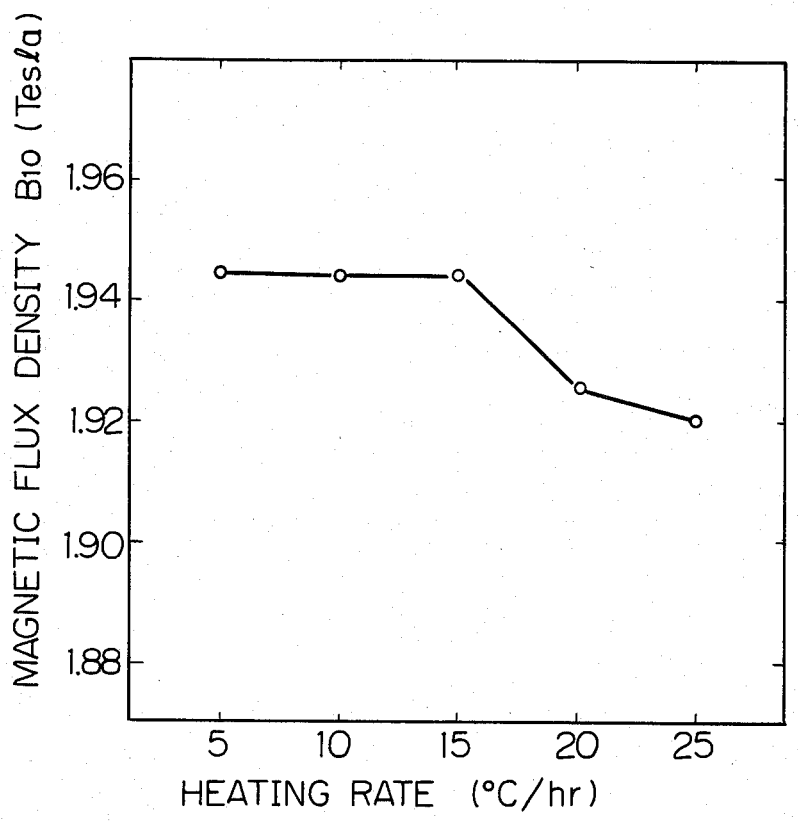
FIG. 4 is a graph of the relationship between the magnetic flux density ($b_{10}$) of products and the heating rate in a temperature range of from 700° C. to 1100° C., such heating being carried out during a final high temperature annealing.

From FIG. 4, it will be understood how the magnetic flux density $B_{10}$ is influenced by the heating rate in a temperature range of from 700° C. to 1100° C.

Molten steel which contained 0.060% of C, 3.35% of Si, 0.25% Mn, 0.033% of acid-soluble Al, 0.030% of P, 0.005% of S, and 0.0085% of N, was continuously cast to form a strand. Slabs cut from a strand were heated to 1400° C. and then hot-rolled to form a 2.3 mm thick hot-rolled strips. Then, the following processes were successively carried out: continuous annealing at 1200° C. for 2 minutes; cold-rolling to form a 0.30 mm cold-rolled sheet; decarburization-annealing at 850° C. for 2 minutes in a wet hydrogen atmosphere; application of annealing separator; and final high temperature annealing at 1200° C. for 20 hours. The heating rate was varied in the final high temperature annealing.

As is apparent from FIG. 4, the magnetic flux density $B_{10}$ is higher when the heating rate is lower. The magnetic flux density $B_{10}$ is particularly high when the heating rate is 15° C./hour or less.

During slow heating at a temperature range of from 700° C. to 1100° C., the secondary recrystallization is completed. At a heating rate lower than 15° C./hour, the magnetic flux density does not greatly vary depending upon temperature, but the value-dispersion of the magnetic flux density decreases at a low heating rate. The minimum heating rate is desirably 7° C./hour in the light of economic efficiency. Final high-temperature annealing is usually carried out at a temperature of 1100° C. or more in a hydrogen atmosphere or a mixture atmosphere containing hydrogen.

The temperature is then usually elevated to approximately 1200° C. and purification annealing is carried out so as to reduce N and S in steel to a level as small as possible.

After the final high temperature annealing, a coating liquid mainly composed of, for example, phosphoric acid, chromic acid anhydride, and aluminum phosphate is applied on the steel strip, and annealing for flattening is carried out. Due to the coating film, the insulating film is further strengthened and can generate a high tension.

The grain-oriented electrical steel sheet may contain, in addition to the above described elements, a minor amount of one or more additive elements, for example, Cr.

Continuous casting slabs which contained 0.06% of C, 3.33% of Si, 0.30% of Mn, 0.035% of P, 0.030% of acid-soluble Al, 0.0085% of N, 0.004% S, and varying contents of Cr were heated to 1350° C. and hot-rolled to form 2.3 mm thick hot-rolled sheets. Then, the following processes were successively carried out: continuous annealing at 1120° C. for 2 minutes; cold-rolling to form 0.30 mm cold-rolled strips; decarburization-annealing in a wet hydrogen atmosphere; application of MgO as annealing separator; and final high temperature annealing at 1200° C. for 20 hours.

Figure 5:
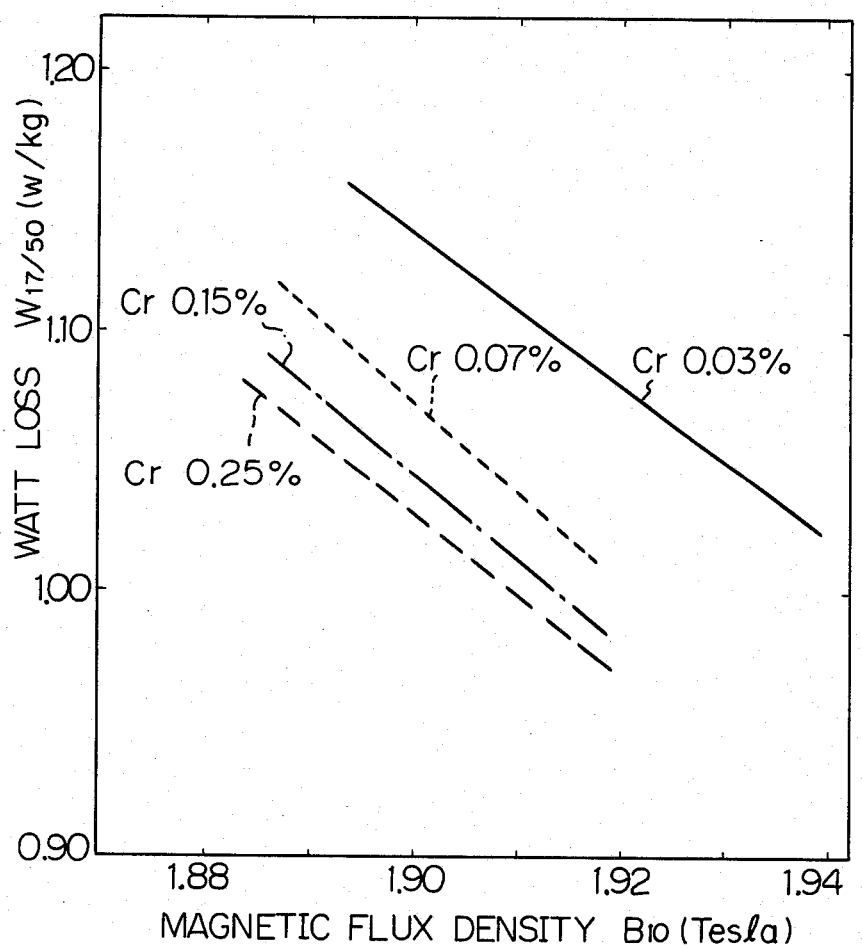
FIG. 5 is a graph of the relationship between the magnetic flux density, the watt loss, and Cr content.
Figure 6:
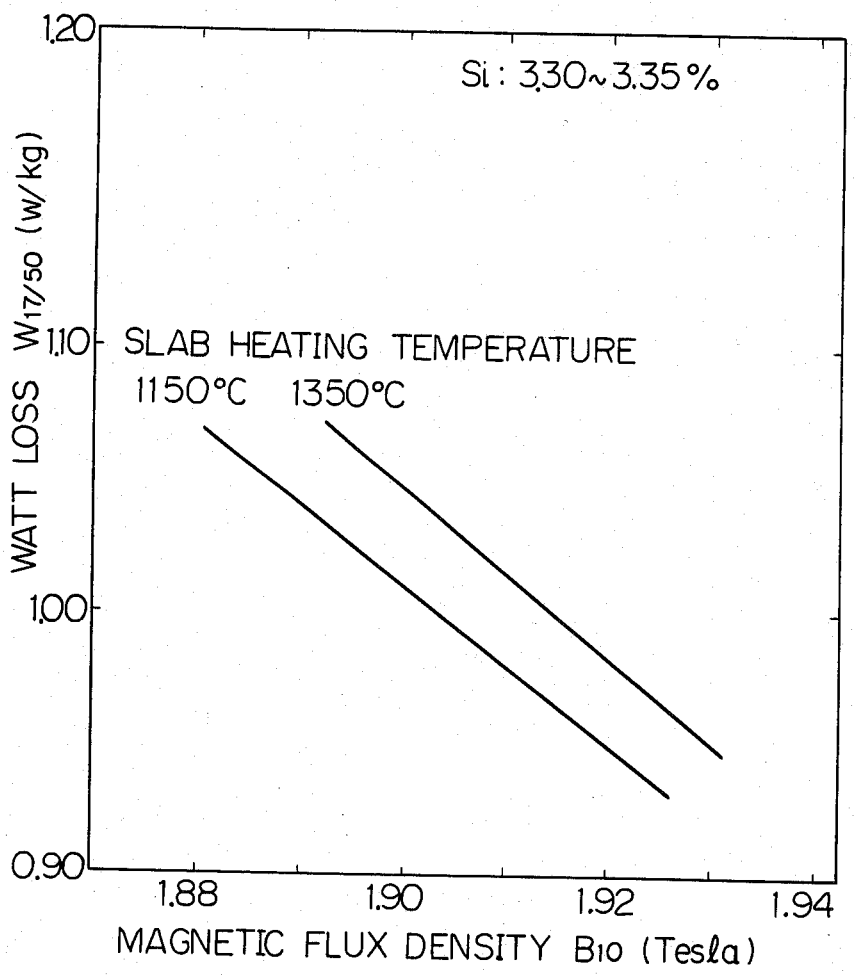
FIG. 6 is a graph showing relationship between $B_{10}$ and $W_{17/50}$ regaridng Cr-containing steels.

Cr can advantageously broadened the range of the acid-soluble Al at which a high magnetic flux density is obtained. From FIG. 5, it will be understood that Cr can also decrease the watt loss for identical magnetic flux densities. A Cr content exceeding 0.25%, is however, inappropriate because the effects of Cr are not enhanced and the decarburization rate is lowered in the decarburization annealing.

EXAMPLE 1

Molten steel which contained 0.060% of C, 3.30% of Si, 0.20% of Mn, 0.035% of P, 0.006% of S, 0.033% of acid-soluble Al, and 0.0080% of N, was cast by continuous casting to form slabs. Slabs were heated to 1380° C. and then hot rolled to form 2.3 mm thick hot-rolled sheets. Then, the following processes were successively carried out: annealing at 1130° C. for 2 minutes; cold-rolling to form a 0.30 mm cold-rolled sheet; decarburization-annealing at 850° C. in a wet hydrogen atmosphere; application of MgO; and final high temperature annealing at 1200° C. for 20 hours. The heating rate at a temperature of from 700° C. to 1100° C. was 10° C./hour in the final high-temperature annealing. Flattening annealing was carried out and then a tension film mainly composed of chromic oxide anhydride was applied on the sheet surface.

The magnetic properties of the product in the rolling direction were as follows:

$B_{10}$=1.93 Tesla $W_{17/50}$=1.02 w/kg.

The product was then irradiated with a laser beam to form spot-like irradiation regions in the C direction (perpendicular to the rolling direction).

The magnetic properties of the laser-irradiated product were excellent as follows.

$B_{10}$=1.93 Tesla $W_{17/50}$=0.91 Tesla

EXAMPLE 2

Molten steel which contained 0.057% of C, 3.45% of Si, 0.29% of Mn, 0.039% of P, 0.003% of S, 0.032% of acid-soluble Al, and 0.0090% of N, was cast by continuous casting to form slabs. Slabs were heated to 1380° C. and then hot rolled to form 2.3 mm thick hot-rolled sheets. Then, the following processes were successively carried out: annealing at 1130° C. for 2 minutes; cold-rolling to form 0.30 mm cold-rolled strips decarburization-annealing at 850° C. in a wet hydrogen atmosphere; application of MgO; and final high temperature annealing at 1200° C. for 20 hours. The heating rate at a temperature of from 700° to 1100° C. was 20° C./hour in the final high-temperature annealing. Flattening annealing was carried out and then a tension film mainly composed of chromic oxide anhydride was applied on the sheet surface.

The magnetic properties of the product in the rolling direction were as follows.

$B_{10}$1.92 Tesla $W_{17/50}$=1.05 w/kg

We claim:

1. A method for producing a grain-oriented electrical steel sheet having high magnetic flux density in terms of $B_{10}$ of 1.89 Tesla or more comprising the steps of:

heating, to a temperature of from more than 1280° C. to 1430° C., a slab which essentially consists of from 0.025% to 0.075% of C, from 3.0% to 4.5% of Si, from 0.01% to 0.060% of acid soluble aluminum, from 0.0030% to 0.0130% of N, not more than 0.007% of S, from 0.08% to 0.45% of Mn, and from 0.015% to 0.045% of P, the balance being Fe;

subsequently hot rolling said slab to form a hot-rolled strip;

annealing said hot-rolled strip in a temperature in the range of from 850° C. to 1200° C. for a short period of time;

subsequently heavily cold-rolling the annealed strip at a reduction of not less than 80%, thereby obtaining the final sheet thickness;

continuously decarburization-annealing the obtained cold-rolled strip in a wet hydrogen atmosphere and then applying an annealing separator on the strip; and subsequently carrying out a final high temperature annealing.

2. A method according to claim 1, wherein in the final high temperature annealing step a heating rate in a temperature range of from 700° C. to 1100° C. is not more than 15°° C./hour.

3. A method according to claim 1, wherein said slab is a continuously cast slab.

4. A grain-oriented electrical steel sheet having high magnetic flux density in terms of $B_{10}$ of 1.89 Tesla or more, formed from a slab essentially consisting of from 0.25% to 0.075% C, from 3.0 to 4.5% of Si, from 0.010% to 0.060% of acid soluble aluminum, from 0.0030% to 0.0130% of N, not more than 0.007% of S, from 0.08% to 0.45% of Mn, and from 0.015% to 0.045% of P, the balance being essentially Fe, wherein said sheet is produced by heating said slab to a temperature of from more than 1280° C. to 1430° C. and by suppressing, prior to final high temperature annealing, secondary recrystallization by means of an inhibitor determined by the composition of said slab.

* * * * *

UNITED STATES PATENT AND TRADEMARK OFFICE

CERTIFICATE OF CORRECTION

PATENT NO. : 4,623,406

DATED : November 18, 1986

INVENTOR(S) : Y. Suga et al.

It is certified that error appears in the above-identified patent and that said Letters Patent is hereby corrected as shown below:

Title page: [75] Inventors: delete "Fumio Matsumoto, Kawasaki" and insert -- Toyohiko Konno, Kitakyushu --.

Signed and Sealed this

First Day of October, 1991

*Attest:*

*Attesting Officer*

HARRY F. MANBECK, JR.

*Commissioner of Patents and Trademarks*